United States Patent [19]

Cole

[11] 3,960,608

[45] June 1, 1976

[54] MEMBERS HAVING A CUTTING EDGE

[75] Inventor: William L. Cole, Camberley, England

[73] Assignee: Wilkinson Sword Limited, England

[22] Filed: Aug. 2, 1973

[21] Appl. No.: 384,943

[30] Foreign Application Priority Data

Aug. 5, 1972 United Kingdom ..... 36646/72

[52] U.S. Cl. ..... 30/346.54; 148/6; 148/6.35; 427/248; 427/405; 427/409

[51] Int. Cl.[2] ..... C23C 13/00; B26B 21/54

[58] Field of Search ..... 148/6, 6.35; 30/346.53, 30/346.54; 204/192; 117/132 CF, 75, 71 M

[56] References Cited

UNITED STATES PATENTS

| | | | |
|---|---|---|---|
| 1,472,851 | 11/1923 | Miyaguchi | 148/6 X |
| 3,712,798 | 1/1973 | Van Thyne et al. | 29/195 A |
| 3,713,907 | 1/1973 | Van Thyne et al. | 148/31.5 |
| 3,743,551 | 7/1973 | Sanderson | 204/192 X |
| 3,774,703 | 11/1973 | Sanderson | 204/192 X |

*Primary Examiner*—Ralph S. Kendall
*Assistant Examiner*—Charles R. Wolfe, Jr.
*Attorney, Agent, or Firm*—Wolfe, Hubbard, Leydig, Voit & Osann, Ltd.

[57] ABSTRACT

The present invention provides a member having a cutting edge with a boron-containing coating thereon, the coating being up to 600 Angstroms thick. The member may be a razor blade.

The invention also provides a method of manufacturing a member having a cutting edge which includes the step of coating the cutting edge with boron to a thickness up to 600 Angstroms.

13 Claims, No Drawings

MEMBERS HAVING A CUTTING EDGE

The invention relates to members having a cutting edge and to methods of manufacture thereof. The invention is particularly applicable to razor blades.

According to the present invention there is provided a member having a cutting edge with a boron-containing coating thereon, the coating being up to 600 Angstroms thick.

The invention also provides a razor blade having a cutting edge, said cutting edge having a boron-containing coating thereon, the coating being up to 600 Angstroms thick.

The invention further provides a method of manufacturing a member having a cutting edge which includes the step of coating the cutting edge with boron to a thickness up to 600 Angstroms.

The boron-containing coating will generally have a thickness of from 50 to 350 Angstroms, for example from 100 to 200 Angstroms.

The boron-containing coating can be applied by known methods, for example by radio frequency sputtering, by evaporation e.g. using an electron beam, or by chemical vapour deposition. Radio frequency sputtering is generally preferred and commercially available apparatus may be used.

Prior to deposition of the boron-containing coating, the cutting edge and/or areas adjacent thereto onto which the coating is to be deposited are preferably cleaned. Examples of suitable cleaning methods include the use of a solvent, for example a halogenated hydrocarbon solvent such as trichloroethylene, preferably in conjunction with an ultrasonic cleaning method, heat treatment, or glow discharge or sputter cleaning.

In general, satisfactory boron-containing coatings can be dsposited by radio frequency sputtering at a pressure of from 0.1 to 10 microns of mercury. The residual atmosphere during sputtering is preferably an inert gas, for example helium or argon. In effecting the radio frequency sputtering of boron it is desirable to avoid contamination of the deposited coating, contamination arising for example from sputtering of the material of the boron target supports, since the contaminant may adversely affect the shaving performance of a polymer coating subsequently applied to the boron-containing coating.

The deposition of the boron can be effected directly to produce a sharp cutting edge. In general, sharp cutting edges can be produced if the cutting edge onto which the boron is deposited is itself sharp. However, a sharp cutting edge can be formed in the boron-containing coating by known methods such as, for example, grinding and honing.

Particularly preferred embodiments of the invention are razor blades and the boron-containing coating will then generally be on an iron-containing material such as, for example, a steel. Stainless steel is particularly preferred, especially for razor blades.

In the case of razor blades, for example, the cutting edges will generally have a coating of a polymer which improves the shaving properties of the blades. Any of the known polymers used for improving the shaving properties of razor blades may be used and they may be applied by known methods. Examples of suitable polymers include polytetrafluoroethylene and copolymers of tetrafluoroethylene and thiocarbonyl fluoride.

Embodiments of the present invention in the form of razor blades may, if desired, have a further coating of a material which improves or enhances the effect on shaving properties conferred by a polymer coating. The boron-containing coating itself may serve to enhance the effect of a polymer coating. Examples of materials which may be used to provide a further coating include metals, e.g. chromium, alloys e.g. chromium alloys such as, for example iron/ chromium alloys, and refractory materials e.g. chromium nitride. Stainless steel is an example of an iron/chromium alloy which may be used. In general, the further coatings will be from 50 to 500 Angstroms thick and preferably less than 200 Angstroms thick. The further coatings may be applied by known methods.

I claim:

1. A ferrous member having a cutting edge with a distinct boron coating thereon, the coating being from 50 to 600 Angstroms thick.

2. A member according to claim 1, wherein the coating is from 50 to 350 Angstroms thick.

3. A member according to claim 1, wherein the coating is from 100 to 200 Angstroms thick.

4. A razor blade having a cutting edge, said cutting edge having a distinct boron coating thereon, the coating being from 50 to 600 Angstroms thick.

5. A razor blade according to claim 4, wherein the coating is from 50 to 350 Angstroms thick.

6. A razor blade according to claim 4, wherein the coating is from 100 to 200 Angstroms thick.

7. A razor blade according to claim 4, having a shaving-enhancing fluorocarbon polymer coating on said cutting edge and having a further coating between said boron coating and said polymer coating, said further coating being selected from the group consisting of a metal, an alloy and a refractory metal compound, for enhancing the shaving properties conferred by the polymer coating.

8. A razor blade according to claim 7, wherein said further coating is selected from the group consisting of chromium and chromium alloys.

9. A razor blade according to claim 7, wherein said further coating is of chromium nitride.

10. A razor blade according to claim 9, wherein said further coating is from 50 to 500 Angstroms thick.

11. A razor blade according to claim 9, wherein said further coating is from 50 to 200 Angstroms thick.

12. A method of manufacturing a ferrous member having a cutting edge which includes the step of coating the cutting edge with boron to a thickness of from 50 to 600 Angstroms.

13. A method according to claim 12, wherein a sharpening process is applied to the cutting edge after formation of the boron coating.

* * * * *